United States Patent [19]

Merten et al.

[11] 4,456,307

[45] Jun. 26, 1984

[54] CUTTER BIT ASSEMBLY

[75] Inventors: Gerhard Merten, Lunen; Oswald Breuer, Dortmund; Norbert Hesse; Bernd Steinkuhl, both of Lunen, all of Fed. Rep. of Germany

[73] Assignee: Gewerkschaft Eisenhutte Westfalia, Lunen, Fed. Rep. of Germany

[21] Appl. No.: 392,353

[22] Filed: Jun. 25, 1982

[30] Foreign Application Priority Data

Mar. 16, 1982 [DE] Fed. Rep. of Germany ..... 3209410

[51] Int. Cl.[3] ..... E21B 10/00

[52] U.S. Cl. ..... 299/93; 407/41; 407/49

[58] Field of Search ..... 299/91, 92, 93; 175/383; 37/142 R, 142 A; 407/41, 46, 49

[56] References Cited

U.S. PATENT DOCUMENTS

| | | | |
|---|---|---|---|
| 2,111,785 | 3/1938 | Kittrell | 37/142 A |
| 2,123,213 | 7/1938 | Simmons | 299/93 |
| 2,272,692 | 2/1942 | Dartnell | 299/93 |
| 4,182,058 | 1/1980 | Poncin | 37/142 A |
| 4,271,615 | 6/1981 | Jones | 37/142 A |

FOREIGN PATENT DOCUMENTS

| | | | |
|---|---|---|---|
| 1291708 | 4/1969 | Fed. Rep. of Germany | 299/91 |
| 2355554 | 5/1975 | Fed. Rep. of Germany . | |

*Primary Examiner*—James A. Leppink
*Assistant Examiner*—Beverly E. Hjorth
*Attorney, Agent, or Firm*—Thompson, Birch, Gauthier & Samuels

[57] ABSTRACT

A cutter bit assembly comprises a holder and a cutter bit. The holder is formed with a pocket into which the cutter bit can be inserted. The cutter bit is retained within the pocket by means of an arcuate wedge inserted into a tapered gap formed between respective curved support faces formed on the cutter bit and the holder.

21 Claims, 8 Drawing Figures

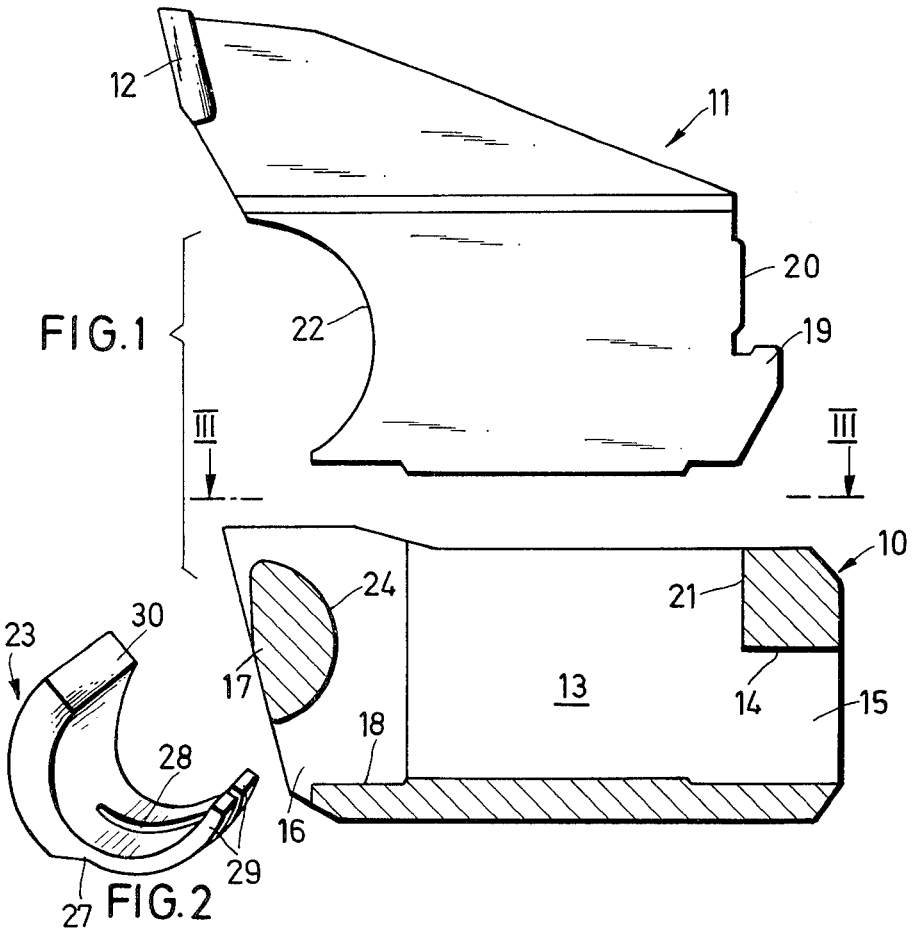
FIG.1
FIG.2
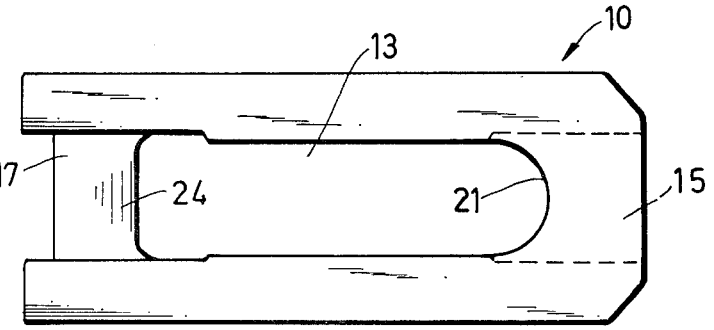
FIG.3

CUTTER BIT ASSEMBLY

BACKGROUND OF THE INVENTION

This invention relates to a cutter bit assembly, and in particular to a cutter bit assembly for a mineral winning machine such as a coal plough.

A known coal plough cutter bit assembly has a holder defining a pocket in which a body portion of a cutter bit is received. The cutter bit may have a projection which hooks into a recess in an end wall of the holder, while the other end of the cutter bit body is held in place by a detachable securing device. The detachable securing device may be a liner which is inserted into a gap between opposed surfaces of the cutter bit body and the holder. A known type of liner is constituted by a thin metal plate which is loosely inserted into this gap. The plate (liner) is held in place by, for example, a dowel sleeve which is driven through aligned bores in the liner and the cutter bit body. In order to release the cutter bit from the holder, it is first necessary to release the dowel sleeve and to remove the liner. The cutter bit can then be moved forward in the pocket a sufficient distance to unhook the projection of the cutter bit body from the recess in the end wall of the holder. Thereafter, the cutter bit can be swung laterally out of the pocket of the holder, the open end of which pocket is directed towards the face being won. An assembly of this type is described in DE-PS No. 1291708.

In another known cutter bit assembly of this type, the dowel sleeve is replaced by a locking plate. The locking plate is bent over towards the outer face of the holder (or the cutter bit body) to hold the liner in place. (See DE-OS No. 2 355 554).

In the known types of cutter bit assembly, the parts of the holder which support the cutter bit body undergo deformation and wear during use. This is because of the jolting of the cutter bit body against the support faces of the holder. The wear of the support surfaces of the holder (and the wear of the associated parts of the cutter bit body) is undesirable, as it results in a loose fit of the cutter but within the holder.

The aim of the invention is to provide a cutter bit assembly whose cutter bit can be firmly and reliably secured in its holder; and which can, when necessary, be quickly and easily retightened.

SUMMARY OF THE INVENTION

The present invention provides a cutter bit assembly comprising a holder and a cutter bit, the holder being formed with a pocket into which the cutter bit is insertable, wherein the cutter bit is, in use, retained within the pocket by means of an arcuate wedge inserted into a gap formed between respective curved support faces formed on the cutter bit and the holder.

Advantageously, the curved support faces are formed at respective first ends of the cutter bit and the holder. Preferably, the cutter bit is formed with a projection which is engageable with a complementarily-shaped portion of the holder to help retain the cutter bit within the pocket, the projection and the complementarily-shaped portion being formed on respective end portions of the cutter bit and the holder remote from said first ends.

In a preferred embodiment the cutter bit support face is concave and the holder support face is convex. Conveniently, the centres of curvature of the two support faces are offset from one another, so that, when the cutter bit is fully inserted into the pocket, the support faces define a tapered gap into which the arcuate wedge is insertable. Advantageously, the holder support face is formed on a web positioned at said first end of the holder, and the holder is formed with an aperture, the aperture being positioned adjacent to the web in such a manner that, when the cutter bit is fully inserted into the pocket, the arcuate wedge can be inserted through said aperture and into the gap between the curved support faces.

With the aid of the arcuate wedge, the cutter bit can be firmly clamped within the pocket of the holder. Moreover, if necessary, it can be retightened during use, this being accomplished by, for example, hammer blows applied to the readily accessible thick end of the wedge. The use of the arcuate wedge results in relatively large wedge support faces, so that excessively high specific surface pressures on the wedge and its support faces are avoided.

Advantageously, the curved support face of the holder extends over an arc of at least 130°, and preferably between 150° and 170°. The arcuate wedge can be designed to be self-locking, so that any movement of the wedge out of the tapered gap cannot occur during use. Moreover, the arrangement may be such that the clamping force of the wedge is actually increased by the operational forces which tend to force the cutter bit further into the pocket.

In a preferred embodiment, the thin end portion of the arcuate wedge is of reduced cross-section, said reduced cross-section end portion having a thickness which is smaller than the width of the gap formed between the adjacent portions of the support faces when the cutter bit is fully inserted into the pocket. Advantageously, said reduced cross-section end portion of the arcuate wedge is formed with at least one slot terminating at, and extending substantially at right-angles to, the free end of said portion. This slotted end portion defines thin tongues which can be bent over against the adjacent web of the holder to secure the wedge to the holder. Consequently, a separate locking member (such as a dowel sleeve or a locking plate) is not required. The reduced cross-section of this end portion facilitates the bending over of the tongues.

Preferably, the arcuate wedge extends over an arc which is at least 10° larger than the arc of the curved support face of the holder.

Advantageously, the end portions of the cutter bit and the holder remote from said first ends are formed with respective complementarily curved support surfaces, said support surfaces being engageable when the cutter bit is fully inserted into the pocket. Preferably, the cutter bit is provided with a concave support surface and the holder is provided with a convex support surface. With this arrangement, large support surfaces can be provided on the cutter bit and the holder, so that excessively high specific surface pressures can be avoided at this end of the assembly.

Conveniently, the cutter bit has a cutter bit body and at least one cutting edge, the cutter bit body being insertable into the pocket in the holder, and the or each cutting edge being positioned outwardly of the pocket when the cutter bit body is fully inserted into the pocket. In a preferred embodiment, the cutter bit has two cutting edges, the cutter bit being of symmetrical construction having its two cutter edges symmetrically disposed with respect to a median plane of the cutter body, and with its concave support face and its concave support surface symmetrically disposed with respect to said median plane. In this case, the cutter bit is reversible in the holder.

In another preferred embodiment, a cylindrical rod associated with said end portion of the holder constitutes the support surface of the holder. Advantageously, the two ends of the cylindrical rod are held within complementarily-shaped apertures formed in the holder. Preferably, the two ends of the cylindrical rod are press-fitted into their apertures, and the cylindrical rod is supported by a cylindrical support surface formed in said end portion of the holder. Conveniently, the holder is made by casting, and the cylindrical rod is made of stainless steel.

BRIEF DESCRIPTION OF THE DRAWINGS

Three forms of cutter bit assembly, each of which is constructed in accordance with the invention, will now be described, by way of example, with reference to the accompanying drawings, in which:

FIG. 1 is a part-sectional side elevation of the first form of cutter bit assembly, and shows the cutter bit separated from its holder;

FIG. 2 is a perspective view of a wedge which forms part of the assembly of FIG. 1;

FIG. 3 is a cross-section taken on the line III—III of FIG. 1;

DESCRIPTION OF PREFERRED EMBODIMENTS

Figure 4:
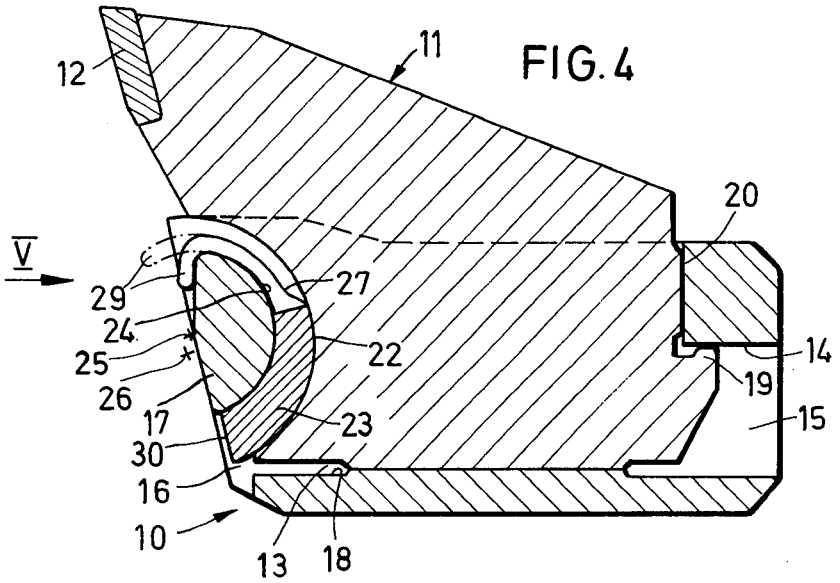
FIG. 4 is a transverse cross-section of the assembly of FIGS. 1 to 3.
Figure 5:
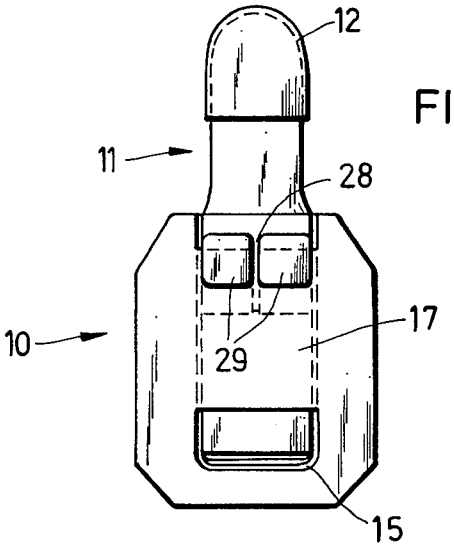
FIG. 5 is a view looking in the direction of the arrow V shown in FIG. 4.

Referring to the drawings, FIGS. 1 to 5 show a cutter bit assembly comprising a holder 10 and a cutter bit 11. The cutter bit 11 has a cutting edge 12 which is constituted by a hard-metal insert. In a known manner, the holder 10 can be fitted, either permanently or in a detachable manner, to a coal plough or other winning machine.

The holder 10 is provided with a pocket 13 which accommodates the cutter bit 11, the pocket being open at the side (that is to say towards the face to be won). One end wall 14 of the pocket 13 is formed with a recess 15, the recess being positioned adjacent to the base 18 of the holder 10 (that is to say remote from the open side of the pocket). The other end of the pocket 13 is provided with a web 17, the web and the base 18 defining an end aperture 16.

The cutter bit 11 is of plate-like construction, and is formed with a projection 19 at the rear end (that is to say the end thereof remote from the cutting edge 12). When the cutter bit 11 is inserted into the pocket 13, the projection 19 hooks round the end wall 14 and into the recess 15 (see FIG. 4), thereby preventing the cutter bit from falling out of the pocket. The cutter bit 11 is formed with a convex end face 20 which, when the cutter bit is inserted fully into the pocket 13, is supported against a complementary concave face 21 formed on the end wall 14.

The front end (that is to say the end adjacent to the cutting edge 12) of the cutter bit 11 is formed with a concave recess 22. The recess 22 defines a support face for an arcuate wedge 23. The rear face 24 of the web 17 defines a concave support face for the wedge 23. As shown in FIG. 4, the centre point 25 of the face 24 is off-set slightly outwardly with respect to the centre point 26 of the face 22, so that the two faces 22 and 24 define a gap which tapers from the end communicating with the end aperture 16. The face 24 of the web 17 extends over an arc of approximately 150° to 170°.

As shown best in FIGS. 2 and 4, the wedge 23 extends over an arc which is approximately 10° to 40° greater than the arc of the face 24. The end zone 27 of the wedge 23 is of reduced thickness as compared with the rest of the wedge. The end zone 27 is also provided with an arcuate slot 28, this slot dividing the end zone to form two thin tongues 29.

In order to position the cutter bit 11 within the holder 10, the cutter bit is introduced, with a rotary movement, into the pocket 13 from the open side. When the projection 19 hooks round the end wall 14 and into the recess 15, and the concave end face 20 of the cutter bit 11 is supported by the face 21 of the holder end wall 14, the wedge 23 is driven into position through the end aperture 16 and into the tapered gap between the faces 22 and 24. This can be done by hammer blows applied to the thick end 30 of the wedge 23. In this way, the cutter bit 11 is firmly fixed within the pocket 13 of the holder 10. In order to retain the wedge 23 in this position, one of the tongues 29 is bent back over the web 17 (see FIGS. 4 and 5). If the cutter bit 11 becomes loosened during use, it can be re-fixed within the pocket 13 by driving the wedge 23 further into the tapered gap defined by the faces 22 and 24. The other tongue 29 can then be bent back over the web 17 to retain the wedge 23 in this new position.

In order to release the cutter bit 11, it is necessary only to drive the wedge 23 out of the tapered gap in the opposite direction to which it was driven in. Prior to driving out the wedge 23, the tongue (or tongues) 29 must be lifted out of the bent-back position. The wedge 23 can be driven out of the tapered gap by hammer blows applied to the tongues 29, or by means of a special tool (not shown) introduced into the reduced end portion of the tapered gap. Alternatively, the end 30 of the wedge 23 may be gripped by a tool, and the wedge pulled out at the end aperture 16.

Figure 6:
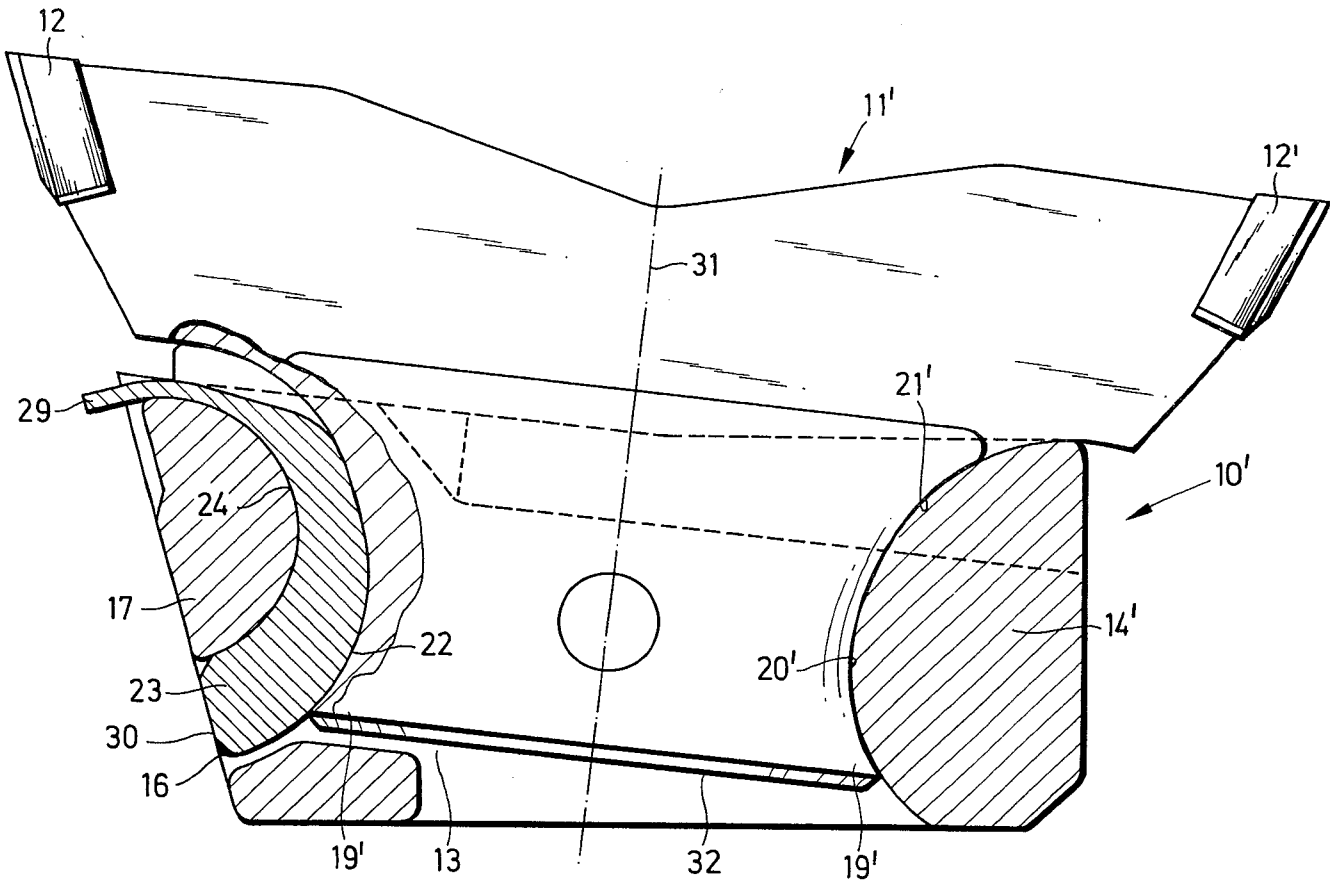
FIG. 6 is a part-sectional side elevation of the second form of cutter bit assembly.

FIG. 6 shows a modified form of cutter bit assembly having a holder 10′ and a cutter bit 11′. This assembly is similar to that of FIGS. 1 to 5, so like reference numerals have been used for like parts, and only the modified parts will be described in detail. Thus, the end wall of the holder 10′ of the FIG. 6 embodiment defines a convex support face 21′, which extends substantially the entire depth of the holder. The contours of the face 21′ correspond substantially with those of arcuate face of the wedge 23 that lies against the concave recess 22 formed at the other end of the holder 10′. The cutter bit 11′ is formed with a rear face 20′, which is of complementary concave shape to the face 21′. This arrangement permits the use of a cutter bit having a single cutting edge, or (as shown in FIG. 6) a cutter bit 11′ having two cutting edges 12 and 12′. The cutter bit 11′ is of symmetrical construction with respect to its median plane 31. Thus, the cutting edges 12 and 12′ and the faces 20′ and 22 are disposed symmetrically with respect to the plane 31. In the assembled position, the rear face 20′ of the cutter bit 11′ is supported by the convex support face 21′ defined by the end wall 14′ of the holder 10′, and the front face 22 of the cutter bit is supported by the wedge 23. Because of its symmetrical shape, the cutter bit 11′ can also be inserted into the holder 10′ so that its face 20′ is supported by the wedge 23, and its face 22 is supported by the face 21′ of the end wall 14′. In either case, the pointed end portion 19′ defined by the face 20′ (or 22) and the base 32 of the cutter bit 11′ constitutes a projection. When the cutter bit 11′ is inserted into the pocket 13 of the holder 10′, one of the portions 19′ engages the lower portion of the convex face 21′, of the holder end wall 14′, thereby preventing the cutter bit 11′ from falling out of the pocket. In other words, the pointed end portions 19′ fulfill the same function as the projection 19 of the cutter bit 11 of the embodiment of FIGS. 1 to 5.

Figure 7:
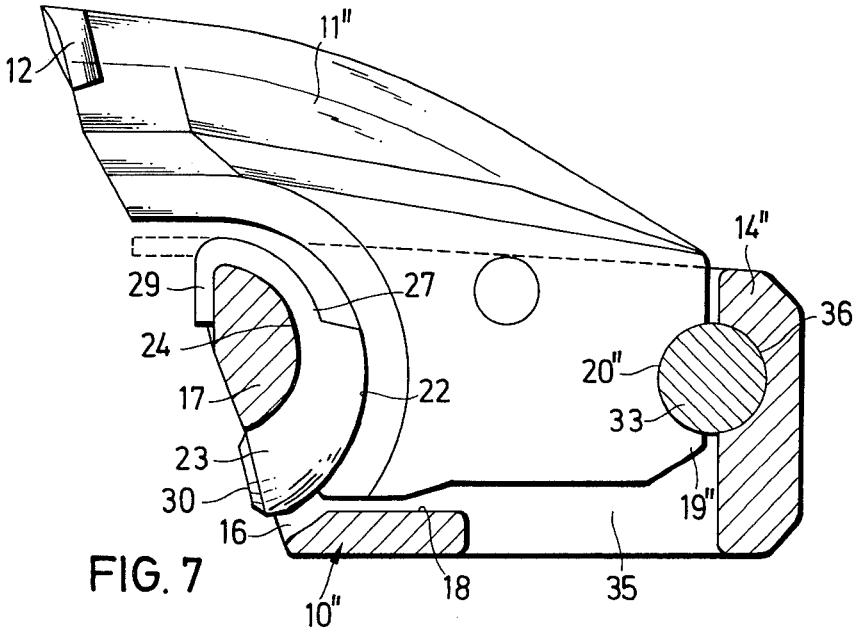
FIG. 7 is a part-sectional side elevation of the third form of cutter bit assembly.
Figure 8:
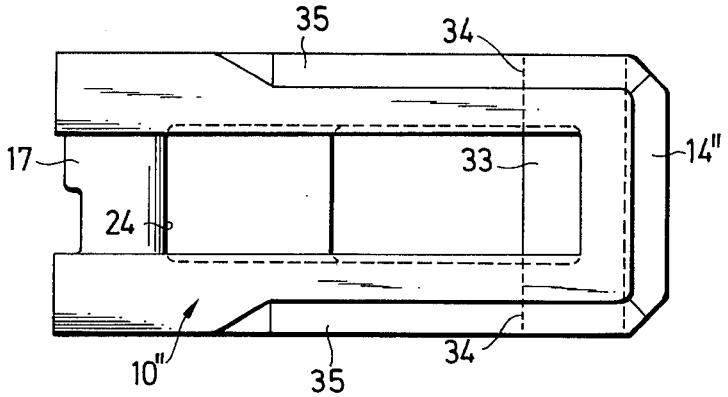
FIG. 8 is a plan view of the holder of the assembly of FIG. 7.

FIGS. 7 and 8 show another modified form of cutter bit assembly having a holder 10″ and a cutter bit 11″. This assembly is also similar to that of FIGS. 1 to 5, so like reference numerals have been used for like parts, and only the modified parts will be described in detail. The main difference between this embodiment and that of FIGS. 1 to 5 is that the rear cutter bit support face (that is to say the support face positioned in the region of the end wall 14″ of the holder 10″) is constituted by a cylindrical rod 33. The two ends of the rod 33 are held in correspondingly-shaped apertures 34 formed in the opposite side walls 35 of the holder 10″, and the rod is supported by a concave, part-cylindrical support face 36 formed in the end wall 14″. The rear end portion of the cutter bit 11″ is formed with a concave, part-cylindrical support face 20″ which bears against the rod 33 when the cutter bit is fully inserted into the holder 10″. The support face 20″ engages the rod 33 over an arc of approximately 160° to 180°. In this embodiment, the curved face 20″ defines a projection 19″ with the base of the cutter bit 11″. This projection 19″ is equivalent to the projection 19 of the embodiment of FIGS. 1 to 5, and engages behind the lower curved portion of the rod 33, thereby preventing the cutter bit 11″ from falling out of the holder 10″.

The holder 10″ is preferably produced by casting, whereas the rod 33 is preferably made of stainless steel. The rod 33 is, advantageously, arranged to be a press fit within the apertures 34. Although the holder 10″ is intended primarily for use with a cutter bit held in position by the arcuate wedge 23, it could also be used with a cutter bit which uses other forms of fixing.

We claim:

1. A cutter bit assembly comprising a holder and a cutter bit, the holder being formed with a pocket into which the cutter bit is mounted, wherein the cutter bit is retained within the pocket against a surface of the holder by means of an arcuate tapered wedge forcibly received in a gap formed between confronting curved support faces formed respectively on the cutter bit and the holder.

2. An assembly according to claim 1, wherein the curved support faces are formed at respective first ends of the cutter bit and the holder.

3. An assembly according to claim 2, wherein the cutter bit is formed with a projection which engages with a complementarily-shaped portion of the holder to help retain the cutter bit within the pocket, the projection and the complementarily-shaped portion being formed on respective end portions of the cutter bit and the holder remote from said first ends.

4. An assembly according to claim 2, wherein the cutter bit support face is concave and the holder support face is convex.

5. An assembly according to claim 4, wherein the centres of curvature of the two support faces are offset from one another, so that, when the cutter bit is fully inserted into the pocket, the support faces define a tapered gap.

6. An assembly according to claim 5, wherein the holder support face is formed on a web positioned at said first end of the holder.

7. An assembly according to claim 6, wherein the holder is formed with an aperture, the aperture being positioned adjacent to the web in such a manner that, when the cutter bit is fully inserted into the pocket, the arcuate wedge can be inserted through said aperture and into the gap between the curved support faces.

8. An assembly according to claim 1, wherein the curved support face of the holder extends over an arc of at least 130°.

9. An assembly according to claim 8, wherein the curved support face of the holder extends over an arc of between 150° and 170°.

10. An assembly according to claim 1, wherein end portion of the arcuate wedge is of reduced cross-section, said reduced cross-section end portion having a thickness which is smaller than the width of the gap formed between the adjacent portions of the support faces when the cutter bit is fully inserted into the pocket.

11. An assembly according to claim 10, wherein said reduced cross-section end portion of the arcuate wedge has a free end which is formed with at least one slot terminating at, and extending substantially at right-angles thereto.

12. An assembly according to claim 1, wherein the arcuate wedge extends over an arc which is at least 10° larger than the arc of the curved support face of the holder.

13. An assembly according to claim 4, wherein the end portions of the cutter bit and the holder remote from said first ends are formed with respective complementarily curved support surfaces, said support surfaces being engageable when the cutter bit is fully inserted into the pocket.

14. An assembly according to claim 13, wherein the cutter bit is provided with a concave support surface and the holder is provided with a convex support surface.

15. An assembly according to claim 14, wherein the cutter bit has a cutter bit body and at least one cutting edge, the cutter bit body being insertable into the pocket in the holder, and said at least one cutting edge being positioned outwardly of the pocket when the cutter bit body is fully inserted into the pocket.

16. An assembly according to claim 15, wherein the cutter bit has two cutting edges, the cutter bit being of symmetrical construction having its two cutter edges symmetrically disposed with respect to a median plane of the cutter body, and with its concave support face and its concave support surface symmetrically disposed with respect to said median plane.

17. An assembly according to claim 15, wherein a cylindrical rod associated with said end portion of the holder comprises the support surface of the holder.

18. An assembly according to claim 17, wherein the two ends of the cylindrical rod are held within complementarily-shaped apertures formed in the holder.

19. An assembly according to claim 18, wherein the two ends of the cylindrical rod are press-fitted into their apertures.

20. An assembly according to claim 17, wherein the cylindrical rod is supported by a cylindrical support surface formed in said end portion of the holder.

21. An assembly according to claim 17, wherein the holder is made by casting, and the cylindrical rod is made of stainless steel.

* * * * *